US006579197B2

(12) United States Patent
Benoit

(10) Patent No.: US 6,579,197 B2
(45) Date of Patent: Jun. 17, 2003

(54) BASKETBALL TRAINING DEVICE

(76) Inventor: Thomas J. Benoit, 67 Lockman Cir., Elgin, IL (US) 60123

( * ) Notice: Subject to any disclaimer, the term of this patent is extended or adjusted under 35 U.S.C. 154(b) by 121 days.

(21) Appl. No.: 09/876,628

(22) Filed: Jun. 7, 2001

(65) Prior Publication Data

US 2002/0187862 A1 Dec. 12, 2002

(51) Int. Cl.[7] ..... A63B 69/00; A63B 69/34; A63B 67/00

(52) U.S. Cl. ..... 473/447; 473/438; 473/442; 473/472; 473/465

(58) Field of Search ..... 473/465–476, 473/441–447, 247, 248, 258; 482/86

(56) References Cited

U.S. PATENT DOCUMENTS

| | | | | | |
|---|---|---|---|---|---|
| 3,675,921 | A | | 7/1972 | Meyers, Sr. | |
| 3,717,342 | A | | 2/1973 | Haney et al. | |
| 4,352,494 | A | | 10/1982 | Wells | |
| 4,989,862 | A | | 2/1991 | Curtis | |
| 5,160,138 | A | | 11/1992 | Sanders | |
| 5,485,993 | A | | 1/1996 | Lipsett | |
| 5,527,185 | A | | 6/1996 | Davis | |
| 5,772,538 | A | * | 6/1998 | Sztykiel et al. | 473/446 |
| 5,776,018 | A | * | 7/1998 | Simpson et al. | 473/433 |
| 5,800,291 | A | * | 9/1998 | Grover | 473/447 |
| 6,224,503 | B1 | * | 5/2001 | Joseph | 473/422 |
| 6,261,195 | B1 | * | 7/2001 | Shingleton | 473/442 |
| 6,280,352 | B1 | * | 8/2001 | Coffeen et al. | 473/447 |
| 6,348,028 | B1 | * | 2/2002 | Cragg | 482/148 |
| 6,458,051 | B1 | * | 10/2002 | Moore | 473/445 |

* cited by examiner

*Primary Examiner*—Valencia Martin-Wallace
*Assistant Examiner*—Robert J. Mendoza
(74) *Attorney, Agent, or Firm*—Mathew R. P. Perrone, Jr.

(57) ABSTRACT

A training device includes a platform mounted on a wheel assembly. The platform has a rail for a support mechanism mounted thereon. On this support mechanism at least one training implement can be mounted and be supported there-around for use by an athlete in contacting the training device. In the platform is a control device for the wheel assembly, in order to adjust movement of the training device with respect to the type of training desired.

20 Claims, 6 Drawing Sheets

BASKETBALL TRAINING DEVICE

This invention relates to a training device, and more particularly to a training device, which permits a coach or an instructor to guide an athlete, a military person, or an entertainer through the proper procedure in carrying out at least one movement required for a particular sport or exercise.

BACKGROUND OF THE INVENTION

Physical fitness has great importance for the human race, whether for a caveman, as a matter of life and death; and for today, as a contribution to the basic well-being of a person. The physically fit person can endure stress more efficiently and feel better while so doing. Physical fitness is also related to mental conditioning. For example, a chess player strives to be in good physical condition, as a necessity before engaging in serious competition.

While lack of physical fitness today usually does not mean a matter of life or death, it can improve the joy of life and provide the ability to participate in athletic competitions. If the conditioning process can more closely imitate a competitive situation, great advantages are obtained.

With military training, the physical aspect can be dangerous. While exposure to controlled danger is a part of military training, it is nevertheless desirable to reduce the dangers therein.

There is also a physical aspect to some forms of entertainment. Certain physical skills used in some forms of entertainment do involve an element of risk. It is desirable to reduce such risk.

In training for athletic competition, it is critical to make the training as realistic as possible. This is done my members of the same team competing against each other. It is also done on occasion by training devices. The main problem with all training devices is that they lack flexibility and cannot provide a complete training capability.

If a training device can be adjusted in order to make the use thereof more closely resemble a game condition or an actual competition condition, great advantages are obtained. Such a structure is difficult to obtain. While there is no replacement for game experience, the idea of creating something even close to a game type of experience with a device is difficult.

The training device must be flexible and adjustable. The device must be suitable for use in developing skill and strengths in various sports. Not all sports have overlapping or the same requirements. Such a training device can be more effective, if useful for a plurality of sports. Such sports include, but are not limited to, basketball, football, soccer, wrestling, rugby, other sports, or wheelchair versions thereof. It may also be used for physical education in health clubs. Additionally, if the device can be developed, physical therapy can be enhanced. Thus, such a device can be extremely useful and adjust for training the players.

SUMMARY OF THE INVENTION

Among the many objectives of this invention is the provision of a training device having a movable platform with various force receiving and measuring devices operably connected therewith.

A further objective of this invention is the provision of a training device having a control mechanism cooperating therewith.

Yet a further objective of this invention is the provision of a training device adapted to receive pressure.

A still further objective of this invention is the provision of a training device adaptable to the height of a person.

Another objective of this invention is the provision of a training device adaptable to one player.

Yet another objective of this invention is the provision of a training device adaptable to more than one player.

Still, another objective of this invention is the provision of a training device promoting proper arm motion.

Also, an objective of this invention is the provision of a training device for use in training in more than one aspect.

A further objective of this invention is the provision of a training device having an entertainment capabilities.

These and other objectives of the invention (which other objectives become clear by consideration of the specification, claims and drawings as a whole) are met by providing a training device, with a platform mounted on a wheel assembly. The platform has a rail for a support mechanism mounted thereon. On this support mechanism at least one training implement can be mounted and be supported therearound for use by an athlete in contacting the training device. In the platform is a control device for the wheel assembly, in order to adjust movement of the training device with respect to the type of training desired.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
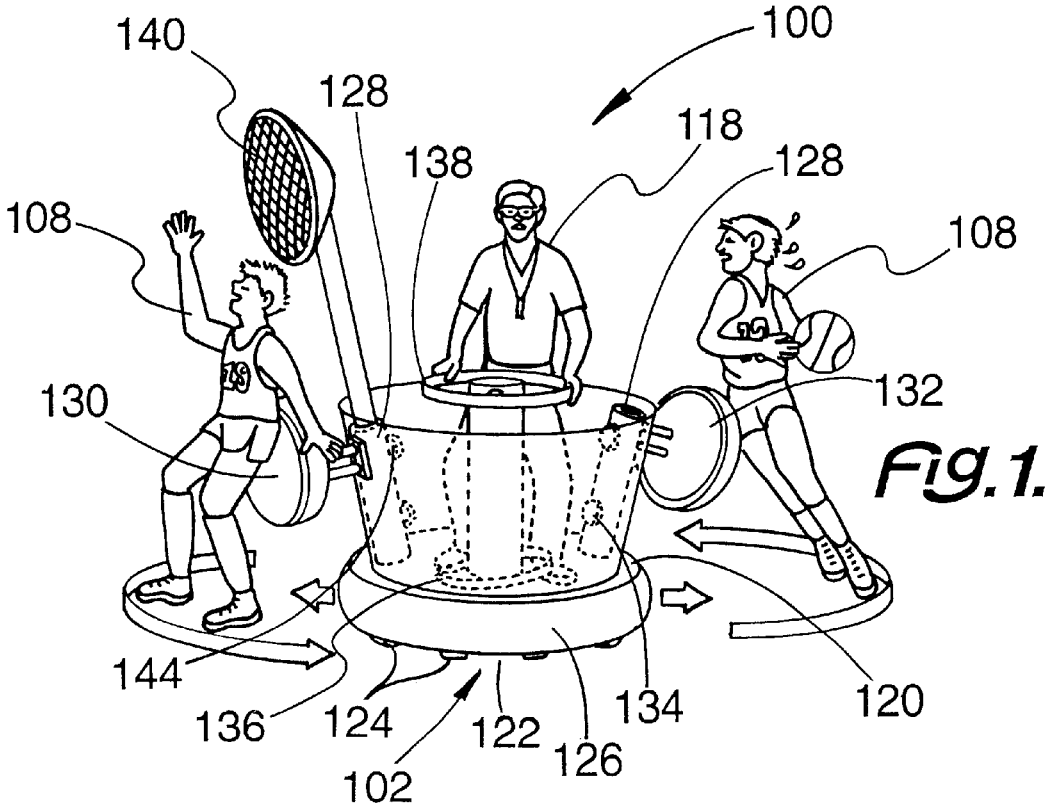
FIG. 1 depicts the training device 100 of this invention showing a first alternative perspective view showing an offensive function 102.

The training device includes a movable platform, a control mechanism for the platform, and hence the training device itself, and various contact elements for a player or other person to use. The platform becomes movable by being mounted on a wheel assembly, which permits a variety of movements for the training device. With these movements, the training device can be moved in any direction as desired. Movement is accomplished by an athlete pushing on the device, by a person on the platform controlling the movement, or by a combination thereof.

Clearly this training device has civil and military applications. For civilian life, this training device benefits the athlete, the game player, the person trying to recover from an injury or the like; and provides a clearly entertainment function in a relatively safe fashion. With a military application, the physical aspect of such becomes more controlled with a corresponding reduction in likelihood of injury.

As used herein that person on the platform may be a coach or a trainer, and may even refer to any type of sports instructor, physical therapist, physical trainer, or similar person, who assists an athlete. The person standing or sitting on the platform controls the training device. The coach can control the braking mechanism for the rollers or the wheel assembly, or control the movement of the training mechanism with the wheel. The braking mechanism and control are standard devices.

An additional option for the platform on the training device, on which the coach or similar person, is the provision of a seat. In this fashion, a person having both the required mental capabilities for training an athlete and a physical challenge may use this training device to supervise such training.

Extending from the training mechanism is at least one pad. The type of pad can be adjusted for any desired sport, and is useful for a plurality of sports. Such sports include, but are not limited to, basketball, football, soccer, wrestling, rugby or other sports. This device is especially useful for a contact sport. The pad may have an electronic readout mechanism. Such a mechanism may provide a readout of pressure or other training information.

As the player puts pressure on the pad, the coach or other operator of the device can control the movement of the wheels and require the player to take action, whether it be an offensive action or a defensive action. Each pad may even have a sensor therein to indicate an appropriate amount of pressure to be put thereon.

Clearly, each pad has a shock absorbing mechanism therein. The shock absorbing mechanism may be a cushion, a hydraulic mechanism or combinations thereof. Whatever purpose the training device is used for, it must be able to resiliently absorb blows.

The training device may also be controlled by a computer. With proper programming, the computer may require the training device to follow a particular pattern, which is determined to enhance training. A printed readout is preferably provided for the coach to study at a more convenient time, while the coach or other trainer may be required to attend to other matters.

Such a readout may be provided for two or more athletes using the training device at the same time. The information thus provided can determine the effectiveness of the predetermined pattern and the interrelation thereof with the athlete.

In this fashion, with the pads extending from the training device, any player can be trained and given the right idea of both, what kind of pressure to put on, and when the pressure is to be applied. The player may also get an idea of how to execute an offensive maneuver or provide defense against the moves of an opposing player. This device can be used for training players in football, basketball or any other sport.

This device has a stationary lock for isometric drills. It can rotate counterclockwise or clockwise, up to 360 degrees and more. It can be made freewheeling and can permit player versus player training. The coach can control the braking resistance. The players can use the pods for defensive or offensive positioning.

An optional sensor can provide an auditory mechanism of determining, whether the appropriate pressure is being applied to the pod. It is also possible to control the training device by computer and have the player compete against a computer. In this fashion, the skills of the coach can be used in the appropriate fashion as desired.

Figure 2:
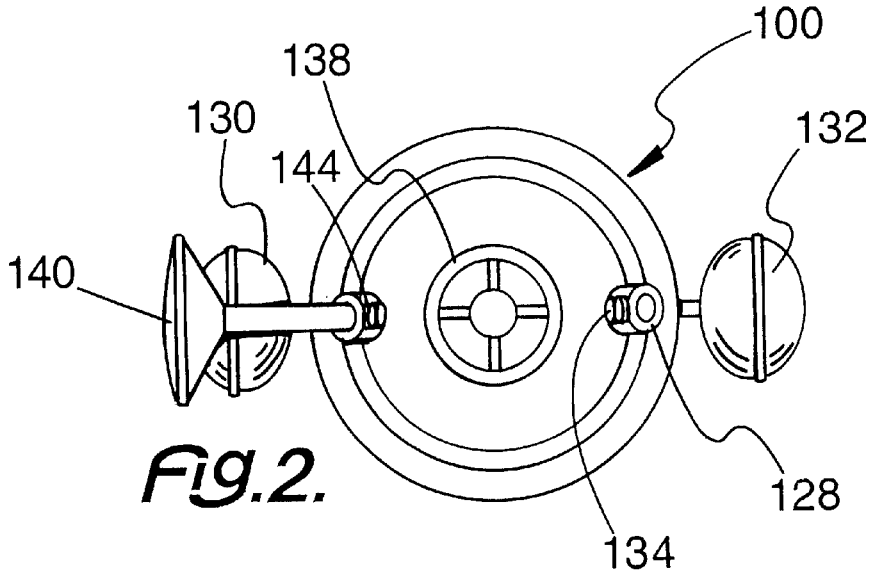
FIG. 2 depicts a top plan view of the training device 100 of this invention based on FIG. 1.

Referring now to FIG. 1 and FIG. 2, training device 100 has the offensive function 102 depicted. There is the platform 120 having the guide wheel 122 mounted thereon. On the platform 120 may stand a person 118. Below the platform 120 is a series of wheels 124, which may direct or permit the training device 100, and hence the platform 120, to move in any suitable fashion under an adjustable resistance.

Around the edge of the platform 120 is padded base 126 designed to protect individuals using the device 100. Mounted on platform 120 are receptor tubes 128. Extending from the receptor tubes 128 are first pressure pad 130 and second pressure pad 132. These pressure pads 130 and 132 are shown as oppositely disposed from each other. However, they can be set in any suitable fashion.

Each of first pressure pad 130 or second pressure pad 132 is mounted in its respective receptor tube 128 in a male to female relationship or vice versa. With each relationship, a clamp mechanism 134 permits a fixable height adjustment. Of course, other suitable devices can be mounted in receptor tubes 128, of which other examples are herein described.

Included on the platform 120 is brake 136 for stopping the series of wheels 124, while the steering wheel 138 permits the adjustment of the position of the training device 120. Such positioning diversity adds much value to the training device 100.

Optionally, a trampoline passing target 140 may be in receptor tube 128 placed on the device 100. In this fashion, the player 108 can be directed and assisted in the idea in keeping contact with the pressure pad 130 or 132. With the contact with the pads 130 or 132, the effectiveness of the defensive stance or the offensive stance is matched.

Also a pinned adjustment mechanism 144 provides a height adjustment mechanism in a standard fashion. Preferably, height adjustment mechanism 144 is a standard and has a knob for moving a pin into a different pin aperture. In this fashion, various elements on training device 100 have a height adjustment, usable depending on the height of an athlete.

Figure 3:
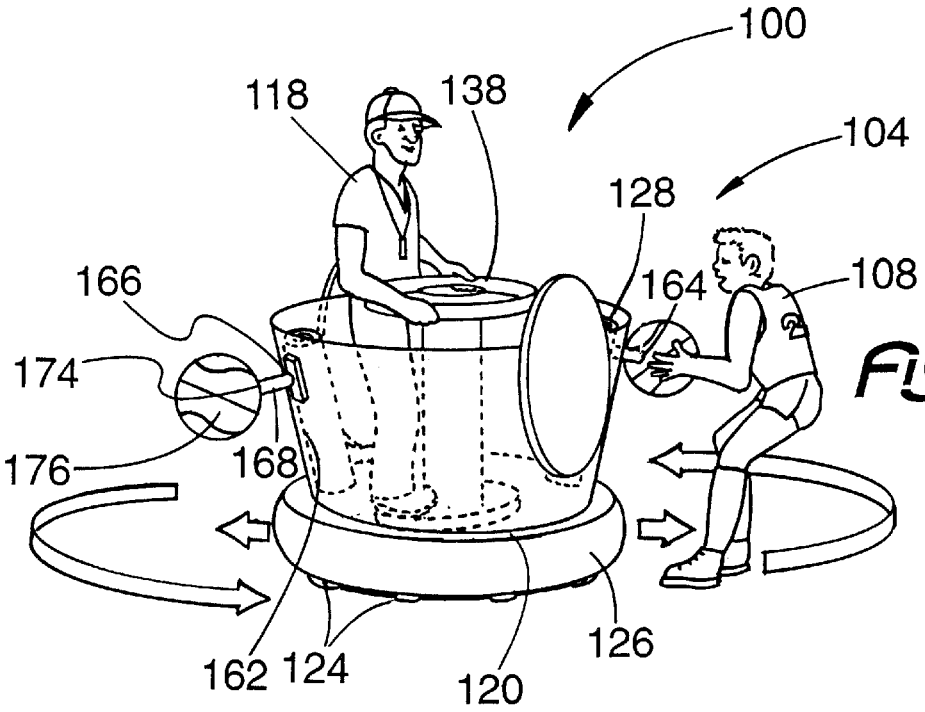
FIG. 3 depicts a second alternative perspective view showing a ball control posture 104 for the training device 100 of this invention in use.
Figure 4:
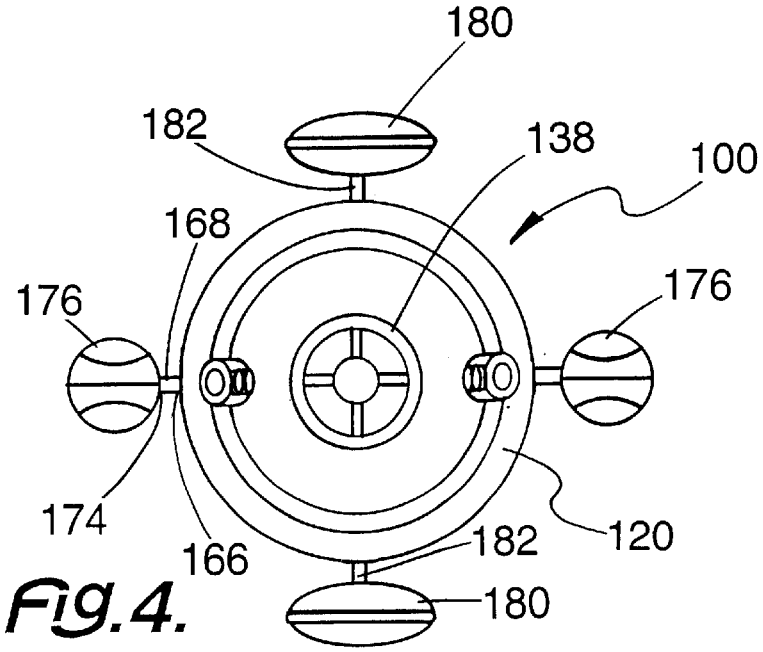
FIG. 4 depicts a top plan view of the training device 100 of this invention based on FIG. 3.

Referring now to FIG. 3 and FIG. 4, training device 100 has the ball control posture 104 depicted. In common with FIG. 1 and FIG. 2, platform 120 has the guide wheel 122 mounted thereon in these Figures. On the platform 120 may stand a person 118. Below the platform 120 is a series of wheels 124, which may direct the platform 120 in any suitable fashion.

Around the edge of the platform 120 is padded base 126 designed to protect individuals using the device 100. Extending from a side area 162 of receptor tube 128 is a ball clamp 164. Ball clamp 164 includes a clamp base 166 secured to side area 162. Extending from and secured to clamp base 166 is clamp rod 168. Extending from and secured to clamp rod 168 is ball holder 174. Clamp base 166 is on clamp rod 168 and oppositely disposed from ball holder 174.

Clamp base 166 is permanently or removably secured to receptor tube 128. Bolting, clamping or other releasable fastening devices are the preferred manners of securing clamp base 166 to receptor tube 128. While any permanent fastening device may be used, such fastening can adversely affect flexibility of training device 100.

Ball holder 174 can firmly receive any type of ball, such as the shown basketball 176. Ball holder 174 has a standard adjustment, which permits flexibility in training of player 108. Ball holder 174 also permits various types of balls to replace basketball 176 in view of a standard gripping adjustment.

Ball clamp 164 and clamp base 166 are secured to clamp rod 168 in any suitable fashion. Welding or another permanent securing device is desired. Such features can easily be determined on an as desired or as needed basis.

Optional defense pads 180 may be secured to rail 182 of the training device 120. As a player or players 108 press against pads 180, the effect of such pressure on training device 100 may be measured. Defense pads 180 are preferably removably secured in receptor tube 128 placed on the device 100. In this fashion, the player 108 can be directed and assisted in the idea in keeping contact with the pressure pad 130 or 132. With the contact with the pads 130 or 132, the effectiveness of the defensive stance or the offensive stance is matched.

Figure 5:
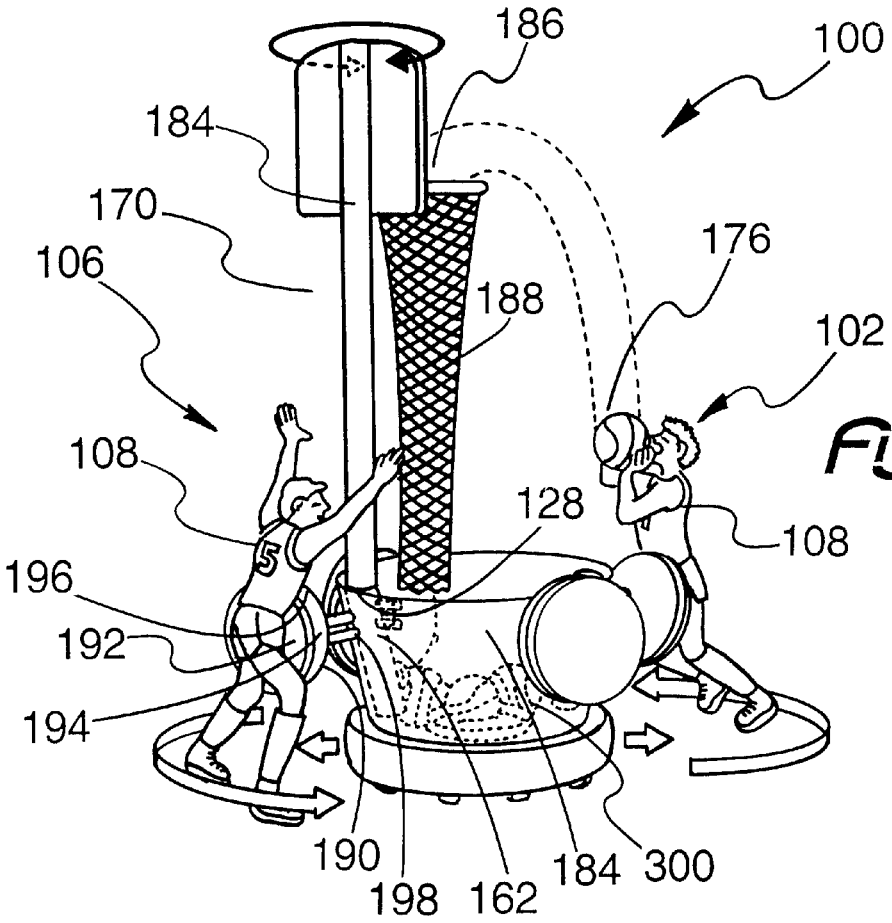
FIG. 5 depicts a third alternative perspective view showing defensive posture 106 of the training device 100 of this invention in use.
Figure 6:
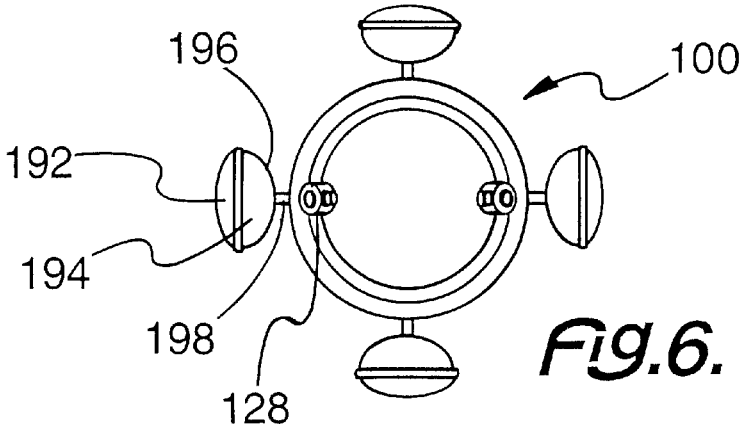
FIG. 6 depicts a top plan view of the training device 100 of this invention based on FIG. 3.

Referring now to FIG. 5 and FIG. 6, training device 100 has both the offensive function 102 and the defensive posture 106 depicted. In common with FIG. 1, FIG. 2, FIG. 3 and FIG. 4, platform 120 has the guide wheel 122 mounted thereon in these Figures. Mounted on receptor tube 128 is reactive pad assembly 190. Reactive pad assembly 190 has a reactive contact pad 192, with at least one pressure sensor 194.

Into the receptor tube 128, a hoop assembly 170 may be inserted. Then the basketball 176 may be shot by player 108 in offensive posture 102. Hoop assembly 170 includes basket pole 184 with basketball hoop 186 mounted thereon. Extending from basketball 186 is direct deposit net 188. Direct deposit net 188 is much longer than the normal basketball net (not shown), which permits basketball 176 to fall directly onto platform 120. Such a structure makes basketball practice more efficient.

On training device 100, more than one hoop assembly 170 may be removably mounted or rotatable within the mount as desired. Basketball hoop 186 may thus be positioned inside or outside of training device 100. If more than one hoop assembly 170 is mounted, a player 108 may be trained on each hoop assembly 170. With the mounting devices disclosed herein, such flexibility is possible.

Reactive contact pad 192 may contain pressure sensors 194 adapted to measure force applied thereto by player 108. Readouts from pressure sensors 194 are fed to a standard source and recorded for evaluation. Reactive contact pad 192 is mounted on side area 162 of receptor tube 128.

Enclosing contact pad assembly 190 has reactive pad base 196 secure to reactive contact pad 192, in order to secure sensors 194 therein. Extending from and secured to reactive pad base 196 is reactive clamp support 198. Reactive clamp support 198 secures reactive pad base 196 and hence contact pad assembly to receptor tube 128. Reactive clamp support 198 a standard height adjustment mechanism to allow a first player 108 to have a different height than a second player 108. Reactive clamp support 198 is mounted in a fashion similar to clamp base 166, and is permanently or removably secured to receptor tube 128. Bolting, clamping or other releasable fastening devices are the preferred manners of securing clamp base 166 to receptor tube 128. While any permanent fastening device may be used, such fastening can adversely affect flexibility of training device 100.

Figure 7:
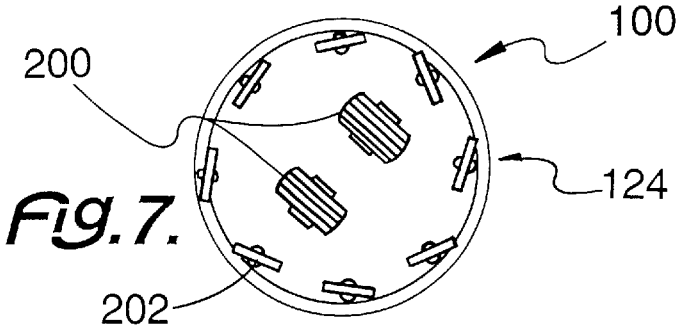
FIG. 7 depicts a bottom plan view of the training device 100 of this invention.

Adding FIG. 7 to the consideration, series of wheels 124, drive wheels 200 thereof are centrally positioned with a plurality of load wheels 202 peripherally positioned. Load wheels 202 support training device 100, while drive wheels 200 may or may not be powered. Drive wheels permit training device 100 to turn with pressure while resisting the pressure.

Figure 8:
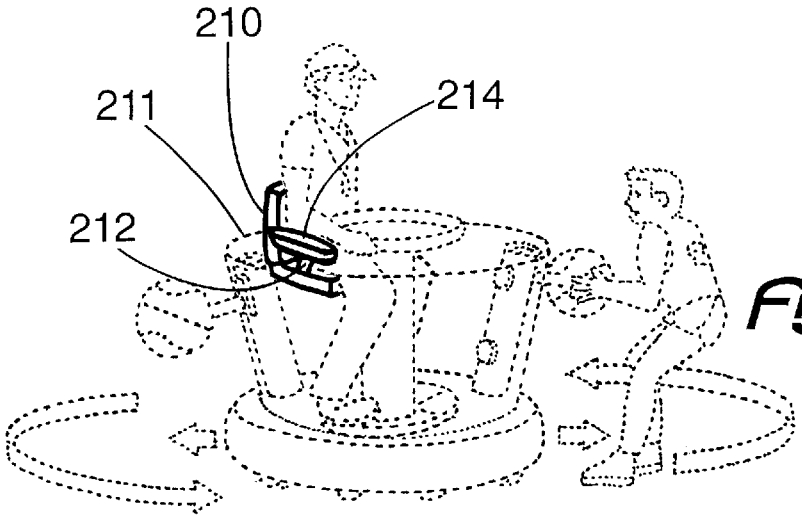
FIG. 8 depicts the training device 100 of this invention shown in phantom with a perspective view of seat 210 on platform 120.

With FIG. 8, training device 100 may have seat 210 on platform 120. Seat 210 has an optional seat belt 212 or arms 214, which may be used jointly or severally. Seat 210 may be permanently or removably attached to the training device 100 and adjustable in height in any standard fashion. With seat 210, training device 100 may have a greatly increased utility.

Figure 9:
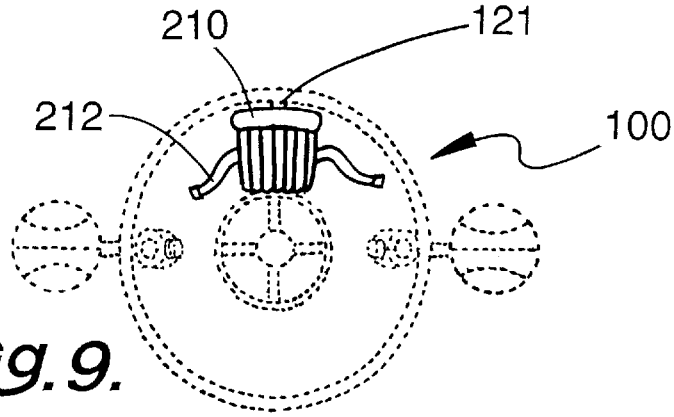
FIG. 9 depicts a top plan view of seat 210 on platform 120, based on FIG. 8.

The top view of seat 210 shown in FIG. 9 leaves off seat belt 212 and arms 214 of FIG. 8. Seat belt 212 and arms 214 are optional and may be permanently or removably attached in a standard fashion. Additionally, arms 214 may be provided with a rotating mechanism, which provides ease of access, greater flexibility and other advantages.

Figure 10:
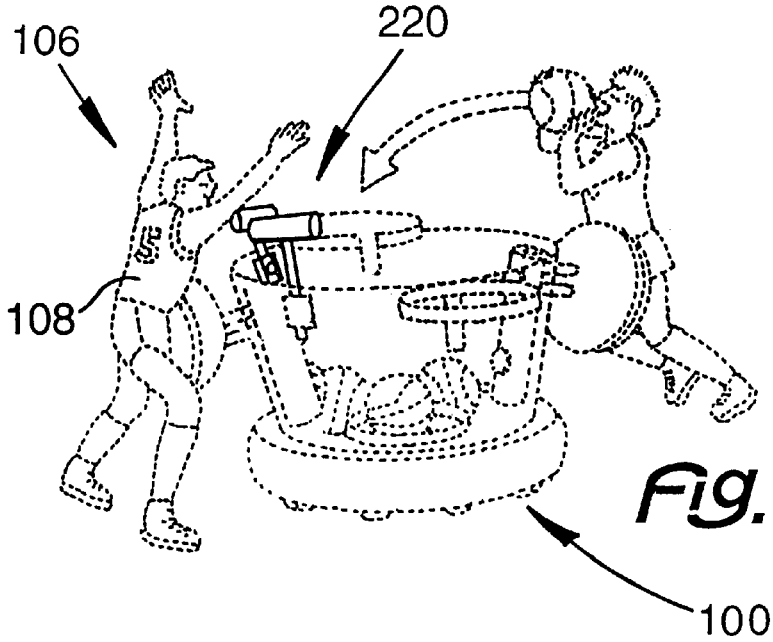
FIG. 10 depicts a third alternative perspective view showing defensive posture 106 of the training device 100 of this invention combined with an arm exercise device 220 in use as an addition to FIG. 5.
Figure 11:
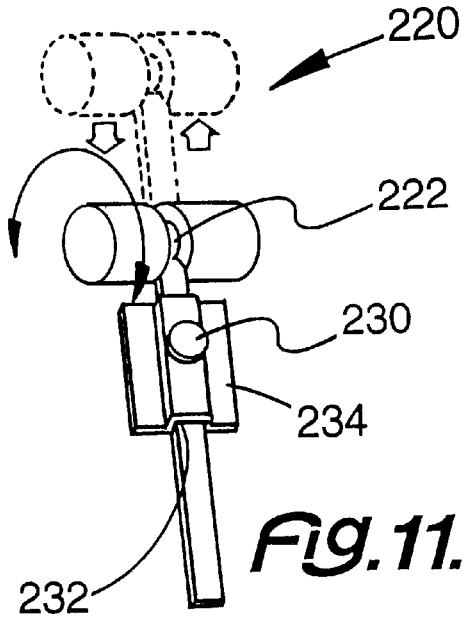
FIG. 11 depicts a top plan view of arm exercise device 220 on platform 120, with rotation mechanism 222.
Figure 12:
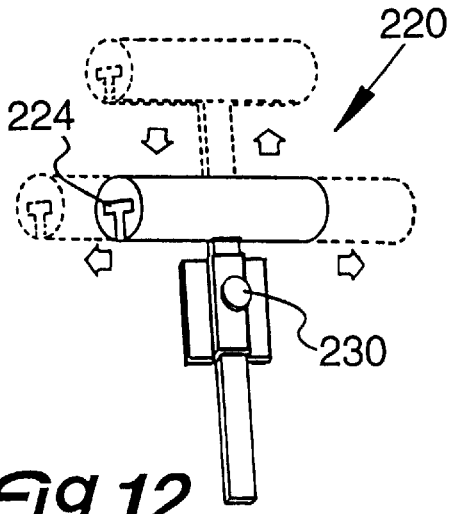
FIG. 12 depicts a top plan view of horizontal arm exercise device 220 on platform 120, with a horizontal mechanism 224.

Referring now to FIG. 10, FIG. 11 and FIG. 12, horizontal arm exercise device 220 comes into play for training and conditioning on hand movement with training device 100. Between rotation mechanism 222 and horizontal mechanism 224, a player 108 is guided to a proper hand usage for the particular activity. As player 108 touches arm exercise device 220, the rotation mechanism 222 moves with arm movement up and down. The horizontal mechanism 224 guides side to side hand movement.

Figure 10A:
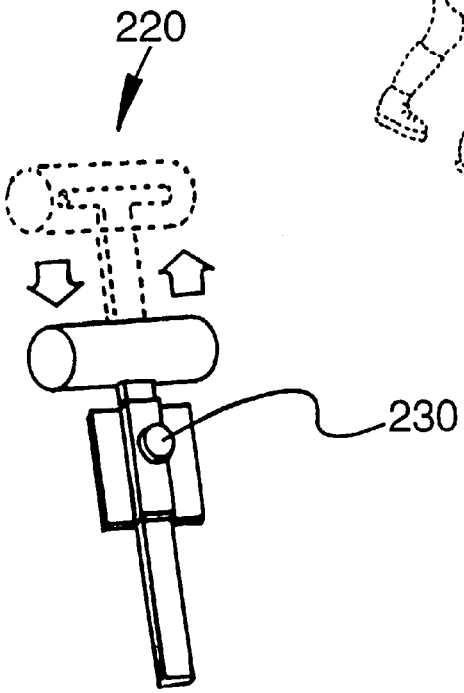
FIG. 10*a* depicts a close-up view of arm exercise device 220 based on FIG. 10.

With height adjustment knob 230 (FIG. 10*a*) in threaded relation with the bar slot 232, bar holder 234 can be secured at a desired point in bar slot 232, thereby providing an appropriate height adjustment horizontal arm exercise device 220. Thus, training device 100 can also provide training for hand movement.

Figure 13:
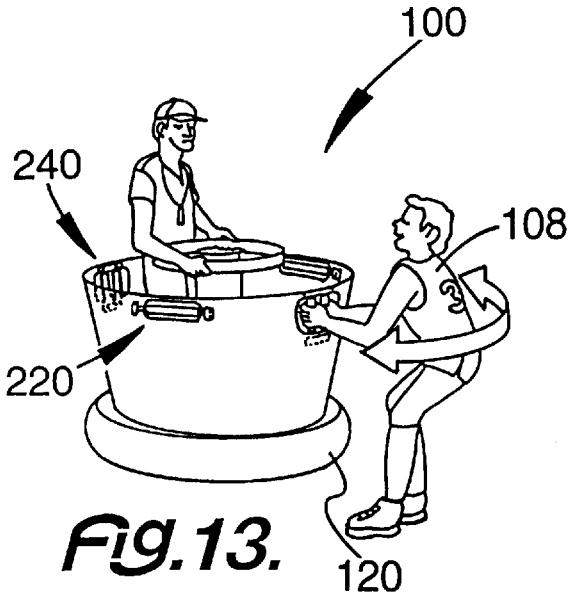
FIG. 13 depicts a perspective view of vertical hand exercise device 240 on platform 120.
Figure 13A:
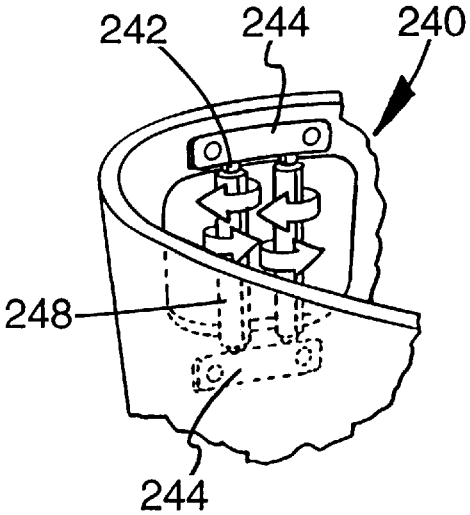
FIG. 13*a* depicts a close-up view of vertical hand exercise device 240 based on FIG. 13.

FIG. 13 has a vertical hand exercise device 240 on platform 120, in order to teach appropriate hand movements. More particularly, vertical hand exercise device 240 has two parallel vertical rods 242 mounted on training device 100. Rod spacers 244 permit vertical rods 242 to be mounted on training device 100 and spaced therefrom in a standard fashion. A rotating cylinder 248 is rotatably mounted on each of vertical rods 242.

Figure 13B:
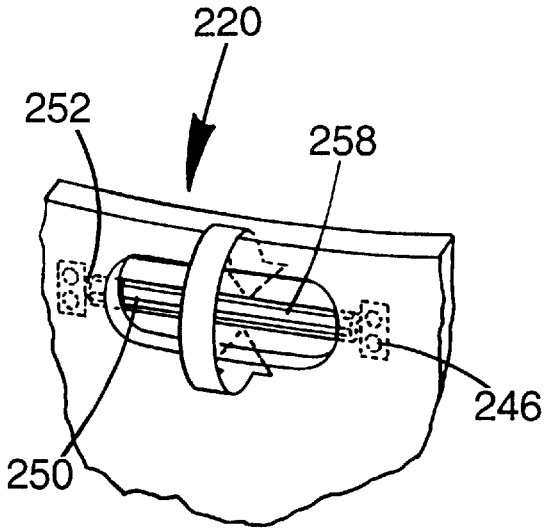
FIG. 13*b* depicts a close-up view of horizontal hand exercise device 250 based on FIG. 13.

Horizontal hand exercise device 250 (FIG. 13*b*) is similar in structure to vertical hand exercise device 240. More particularly, horizontal hand exercise device 250 has preferably one, possibly one, two or more of horizontal rod 252 mounted on training device 100. Rod spacers 244 permit horizontal rod 252 to be mounted on training device 100 and spaced therefrom in a standard fashion. A horizontal rotating cylinder 258 is rotatably mounted on each of horizontal rod 252.

With the vertical rods 242 or the horizontal rod 252 spaced from training device 100, it is possible for player 108 to practice another hand position exercise. Thus, training device 100 adds to training function for an athlete.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters of the United States is:

1. A training device to assist in training a variety of different athletes comprising:

(a) the training device having a platform mounted on a wheel assembly;

(b) the platform including a support mechanism mounted thereon;

(c) the support mechanism having at least one training implement mounted thereon for use by at least one athlete;

(d) a control mechanism cooperating with the training device; and (e) the training device providing adjustable training for the at least one athlete.

2. The training device of claim 1 further comprising:

(a) the training device being movable;

(b) the platform having a variety of movements;

(c) the variety of movements being accomplished by at least one action selected from group consisting of action by the at least one athlete, action by a person on the platform and a combination thereof; and (d) the training device being movable in a variety of directions.

3. The training device of claim 2 further comprising:

(a) the platform receiving an assisting person to assist with training of the at least one athlete;

(b) a control mechanism being operable by the assisting person; and (c) at least one pad being mounted on the platform to assist with training of the at least one athlete.

4. The training device of claim 2 further comprising:

(a) at least one pad being mounted on the platform to assist with training of the at least one athlete;

(b) the at least one pad having an electronic readout mechanism;

(c) a arm exercise device removably attached to the training device; and (d) the electronic readout mechanism providing a readout of pressure or other training information.

5. The training device of claim 4 further comprising:

(a) the readout mechanism including a sensor;

(b) a recording mechanism cooperating with the readout mechanism including a sensor; and (c) the recording mechanism quantifying an effort of the at least one athlete.

6. The training device of claim 5 further comprising:

(a) a computer directing a function of the training device through a predetermined pattern in order to provide training for the at least one athlete;

(b) the readout including a printed tabulation of an interaction between the at least one athlete and predetermined pattern.

7. The training device of claim 6 further comprising:

(a) the training device having a guide wheel operable by the person on the platform;

(b) the guide wheel being operably connected to the wheel assembly;

(c) the platform including a padded base extending upwardly therefrom;

(d) the platform further including at least one receptor tube; and (e) the receptor tube receiving the at least one training implement.

8. The training device of claim 7 further comprising:

(a) the at least one training implement including a first pressure pad and a second pressure pad;

(b) the first pressure pad and the second pressure pad being oppositely disposed on the platform; and (c) a fixable height adjustment mechanism cooperating with the first pressure pad and the second pressure pad.

9. The training device of claim 8 further comprising:

(a) a brake assembly cooperating with the wheel assembly in order to vary the resistance of the training device; and (b) the at least one training implement including at least one selected from the group consisting of a passing target, a hoop target; and a ball control device.

10. The training device of claim 9 further comprising:

(a) the at least one pad being a reactive pad assembly;

(b) the reactive pad assembly having at least one pressure sensor therein; and (c) the at least one pressure sensor providing data to a recording device.

11. The training device of claim 10 further comprising:

(a) the wheel assembly including at least one drive wheel and at least one load wheel;

(b) the at least one drive wheel being centrally located under the platform; and (c) the at least one load wheel being peripherally located under the platform.

12. The training device of claim 11 further comprising:

(a) the training device having a seat for use by the person on the platform; and (b) the person on the platform controlling movement of the training device.

13. The training device of claim 12 further comprising:

(a) the seat having a mounting device for securing the seat to the platform selected from the group consisting of a permanent mounting device and a removable mounting device; and (b) the seat having at least one attachment selected from the group consisting of a seat belt and at least one arm.

14. A training device to assist in training a variety of different athletes comprising:

(a) the training device having a platform mounted on a wheel assembly;

(b) the platform including a support mechanism mounted thereon;

(c) the support mechanism having at least one training implement mounted thereon for use by at least one athlete;

(d) a control mechanism cooperating with the training device;

(e) a wheel assembly supporting the training device;

(f) a brake assembly cooperating with the wheel assembly in order to vary the resistance of the training device; and (g) the training device providing adjustable training for the at least one athlete.

15. The training device of claim 14 further comprising:

(a) the training device being movable on the wheel assembly;

(b) the platform having a variety of movements due to the wheel assembly;

(c) the variety of movements being accomplished by at least one action selected from group consisting of action by the at least one athlete, action by a person on the platform and a combination thereof; and (d) the training device being movable in a variety of directions.

16. The training device of claim 15 further comprising:

(a) the platform receiving an assisting person to assist with training of the at least one athlete;

(b) a control mechanism cooperating with the brake assembly;

(c) a control mechanism being operable by the assisting person;

(d) at least one pad being mounted on the platform to assist with training of the at least one athlete;

(e) the at least one pad having an electronic readout mechanism; and (f) the electronic readout mechanism providing a readout of pressure or other training information.

17. The training device of claim 16 further comprising:

(a) the readout mechanism including a sensor;

(b) a recording mechanism cooperating with the readout mechanism including a sensor;

(c) the recording mechanism quantifying an effort of the at least one athlete;

(d) a computer directing a function of the training device through a predetermined pattern in order to provide training for the at least one athlete;

(e) the readout including a printed tabulation of an interaction between the at least one athlete and predetermined pattern;

(f) the training device having a guide wheel operable by the person on the platform;

(g) the guide wheel being operably connected to the wheel assembly;

(h) the platform including a padded base extending upwardly therefrom;

(i) the platform further including at least one at least one receptor tube; and (j) the receptor tube receiving the at least one training implement.

18. The training device of claim 17 further comprising:

(a) the at least one training implement including a first pressure pad and a second pressure pad;

(b) the first pressure pad and the second pressure pad being oppositely disposed on the platform;

(c) a fixable height adjustment mechanism cooperating with the first pressure pad and the second pressure pad;

(d) a brake assembly cooperating with the wheel assembly in order to vary the resistance of the training device;

(e) the at least one training implement including at least one selected from the group consisting of a passing target, a hoop target; and a ball control device;

(f) the at least one pad being a reactive pad assembly;

(g) the reactive pad assembly having at least one pressure sensor therein; and (h) the at least one pressure sensor providing data to a recording device.

19. The training device of claim 18 further comprising:

(a) the wheel assembly including at least one drive wheel and at least one load wheel;

(b) the at least one drive wheel being centrally located under the platform; and (c) the at least one load wheel being peripherally located under the platform.

20. The training device of claim 19 further comprising:

(a) the training device having a seat for use by the person on the platform;

(b) the person on the platform controlling movement of the training device;

(c) the seat having a mounting device for securing the seat to the platform selected from the group consisting of a permanent mounting device and a removable mounting device; and (d) the seat having at least one attachment selected from the group consisting of a seat belt and at least one arm.

* * * * *